US012800261B2

(12) United States Patent
Geissele et al.

(10) Patent No.: US 12,800,261 B2
(45) Date of Patent: Nov. 17, 2026

(54) LOWER RECEIVER MOUNTED HANDGUARD

(71) Applicant: WHG Properties, LLC, North Wales, PA (US)

(72) Inventors: William H. Geissele, Lower Gwynedd, PA (US); Frank Eric Robinson, Schwenksville, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 18/810,898

(22) Filed: Aug. 21, 2024

(65) Prior Publication Data

US 2025/0146787 A1 May 8, 2025

Related U.S. Application Data

(63) Continuation-in-part of application No. 18/502,798, filed on Nov. 6, 2023.

(51) Int. Cl.
*F41C 23/16* (2006.01)
*F41A 3/66* (2006.01)

(52) U.S. Cl.
CPC ..... *F41C 23/16* (2013.01); *F41A 3/66* (2013.01)

(58) Field of Classification Search
CPC ..... F41C 23/16; F41A 3/66
See application file for complete search history.

(56) References Cited

U.S. PATENT DOCUMENTS

| | | | | |
|---|---|---|---|---|
| 8,769,854 | B1 * | 7/2014 | Battaglia | F41A 11/02 42/75.01 |
| 11,371,802 | B2 * | 6/2022 | Liao | F41A 21/48 |
| 11,519,690 | B2 * | 12/2022 | Aldstadt | F41C 23/16 |
| 12,203,724 | B2 * | 1/2025 | Risley | F41A 5/26 |
| 12,222,177 | B2 * | 2/2025 | Klein | F41C 23/16 |
| 12,281,872 | B2 * | 4/2025 | DiChario | F41C 23/16 |
| 2012/0079752 | A1 * | 4/2012 | Peterson | F41C 23/16 42/75.02 |
| 2014/0331538 | A1 * | 11/2014 | Spiegelhauer | F41C 23/16 42/71.01 |
| 2022/0107154 | A1 * | 4/2022 | Klein | F41A 3/66 |
| 2022/0282950 | A1 * | 9/2022 | Aldstadt | F41C 23/16 |
| 2022/0390198 | A1 * | 12/2022 | Heuss | F41A 3/66 |
| 2024/0085127 | A1 * | 3/2024 | Patel | F41A 11/02 |
| 2025/0146774 | A1 * | 5/2025 | Geissele | F41C 23/16 |
| 2025/0146787 | A1 * | 5/2025 | Geissele | F41G 11/003 |
| 2025/0334370 | A1 * | 10/2025 | Klein | F41A 3/66 |

FOREIGN PATENT DOCUMENTS

EP 4194795 A1 6/2023

OTHER PUBLICATIONS

Extended European Search Report for EP Patent Application No. 24210630.0 dated Mar. 14, 2025 (10 pages).

* cited by examiner

*Primary Examiner* — Michelle Clement
(74) *Attorney, Agent, or Firm* — Alston & Bird LLP

(57) ABSTRACT

A firearm that includes an upper receiver, a barrel coupled to the upper receiver, and a lower receiver coupled to the upper receiver. The firearm includes a handguard and an extension mount that is configured to couple to the lower receiver and is monolithic with or configured to be coupled to the handguard.

16 Claims, 12 Drawing Sheets

LOWER RECEIVER MOUNTED HANDGUARD

CROSS-REFERENCE TO RELATED APPLICATIONS

The present application is a continuation-in-part of and claims the benefit of U.S. application Ser. No. 18/502,798, filed Nov. 6, 2023, the contents of which are hereby incorporated by reference in their entirety.

TECHNICAL FIELD

The present application relates generally to a firearm. More specifically, the present application relates to a firearm that has a handguard that is coupled to a lower receiver.

BACKGROUND

In various circumstances, a user of a firearm may desire to attach a bipod to a handguard or may otherwise use the handguard for supporting the weight of the firearm. When shooting the firearm with the bipod attached, the user may place his cheek on the stock of the firearm to look through optics that may be positioned on a forward end of the rail of the upper receiver or through sights that are positioned on an aft end of the rail of the upper receiver and a forward end of the rail of a handguard. The user may exert a downward force on the stock with his cheek to look through the optics or sights.

Handguards of some existing technologies are directly coupled to the barrel nut, which couples the barrel of the firearm to the upper receiver. When a downward force is exerted on the stock and/or an upward force is exerted on the handguard, the barrel may move relative to the handguard and/or upper receiver, which may reduce the accuracy of the firearm and cause inconsistent operation.

The inventors have identified these and numerous other deficiencies and problems with the existing technologies in this field. Through applied effort, ingenuity, and innovation, many of these identified deficiencies and problems have been solved by developing solutions that are structured in accordance with the embodiments of the present disclosure, many examples of which are described in detail herein.

BRIEF SUMMARY

In general, embodiments of the present disclosure provided herein include systems and apparatuses to provide for improved firearms. More specifically, embodiments of the present disclosure provided herein include a means for coupling a handguard to a lower receiver such that the handguard is only coupled to a barrel nut of the firearm through the lower receiver.

In various aspects, a firearm lower receiver is provided. The firearm lower receiver may include a magazine well and an extension mount positioned at least partially forward of the magazine well relative to a shooting orientation. The extension mount may be configured to couple to a firearm handguard to form a rigid connection between the firearm lower receiver and the firearm handguard.

In various examples, the extension mount includes a clamp. The clamp may clamp include an arm that is configured to pivot.

In various examples, the extension mount includes one or more holes configured to receive a fastener.

In various aspects, an assembly is provided. The assembly may include the firearm lower receiver rigidly coupled to the firearm handguard. The firearm handguard may include an attachment mount at or proximate to a downward aft end of an elongated body of the firearm handguard. The extension mount of the firearm lower receiver may be coupled to the attachment mount of the firearm handguard.

In various aspects, a firearm handguard is provided. The firearm handguard may include an elongated body and an attachment mount at or proximate to a downward aft end of the elongated body. The attachment mount may be configured to couple to an extension mount of a firearm lower receiver to form a rigid connection between the firearm lower receiver and the firearm handguard.

In various examples, the attachment mount includes one or more holes configured to receive a fastener. The one or more holes may extend in an upward direction that is defined by the firearm handguard.

In various examples, the attachment mount includes a pad that extends downward. The pad may define a flat planar surface that includes one or more holes configured to receive a fastener.

In various examples, the attachment mount includes at least one attachment flange. The at least one attachment flange may define a cross-sectional dovetail shape.

In various examples, the attachment mount includes a clamp configured to engage the extension mount of the firearm lower receiver.

In various aspects, a firearm is provided. The firearm may include an upper receiver, a barrel configured to be coupled to the upper receiver, a firearm lower receiver coupled to the upper receiver, and the firearm handguard. The firearm handguard may include an elongated body and an attachment mount. The attachment mount may be configured to couple to an extension mount of the firearm lower receiver to rigidly connect the firearm handguard and the firearm lower receiver.

In various examples, the firearm handguard is only coupled to the upper receiver through the firearm lower receiver.

In various examples, the firearm handguard abuts the upper receiver.

In various examples, the firearm further includes a barrel nut configured to couple the barrel to the upper receiver. A first gap may be defined between portions of the barrel nut that longitudinally align with the firearm handguard. The first gap may be at least 0.01 inch.

In various examples, the firearm further includes a barrel nut configured to couple the barrel to the upper receiver. A second gap may be defined between portions of the firearm handguard that circumferentially surround the barrel nut. The second gap may be at least 0.01 inch.

In various aspects, a firearm is provided. The firearm may include an upper receiver, a barrel coupled to the upper receiver, and a lower receiver coupled to the upper receiver. The lower receiver may include a magazine well and an extension mount positioned forward of the magazine well. The firearm may further include a handguard and a means for coupling the handguard to the extension mount of the lower receiver.

In various aspects, an assembly comprises a firearm lower receiver defining a magazine well and comprises an attachment feature positioned forward of the magazine well. The assembly may comprise an extension mount that is engaged with the attachment feature of the firearm lower receiver. The extension mount may be monolithic with or configured to be coupled to a firearm handguard.

In various examples, the extension mount comprises a clamp and the extension mount is coupled to the firearm lower receiver with the clamp.

In various examples, the clamp comprises a fastener and a moveable portion. The fastener may be configured to move the moveable portion when rotated.

In various examples, the clamp comprises an arm that is configured to pivot and a moveable portion. The arm may be configured to move the moveable portion when pivoted.

In various examples, the assembly comprises one or more fasteners. The extension mount may comprise one or more holes configured to receive each of the one or more fasteners to couple the extension mount to the firearm handguard.

In various examples, the attachment feature is an attachment flange.

In various examples, the firearm lower receiver comprises a rail. The rail may comprise the attachment flange.

In various examples, the rail is a picatinny type rail that is monolithic with a portion of the firearm lower receiver that defines the magazine well.

In various examples, the firearm handguard comprises an elongated body and an attachment mount at or proximate to a downward aft end of the elongated body. The attachment mount may be configured to couple to the extension mount to form a rigid connection between the firearm lower receiver and the firearm handguard.

In various examples, the extension mount and the firearm handguard comprise one or more holes configured to receive a fastener to couple the extension mount to the firearm handguard.

In various aspects, an extension mount for connecting a handguard to a lower receiver of a firearm is provided. The extension mount may comprise a handguard engagement surface configured to engage the handguard and at least one clamp configured to engage an attachment feature of the lower receiver.

In various examples, the handguard engagement surface comprises at least one upwardly-facing opening configured to receive at least one corresponding fastener therethrough to engage the handguard.

In various examples, the at least one clamp is oriented perpendicular to the handguard engagement surface.

In various aspects, a firearm comprises an upper receiver, a barrel coupled to the upper receiver, an assembly coupled to the upper receiver, and a firearm handguard coupled to or monolithic with the extension mount of the assembly. The extension mount may rigidly connect the firearm handguard and the firearm lower receiver. The assembly may comprise a firearm lower receiver defining a magazine well and comprises an attachment feature positioned forward of the magazine well. The assembly may comprise an extension mount that is engaged with the attachment feature of the firearm lower receiver. The extension mount may be monolithic with or configured to be coupled to a firearm handguard.

In various examples, the firearm handguard is only coupled to the upper receiver through the firearm lower receiver.

In various examples, the firearm handguard abuts the upper receiver.

In various examples, the firearm further comprises a barrel nut configured to couple the barrel to the upper receiver. A first gap may be defined between portions of the barrel nut that longitudinally align with the firearm handguard. The first gap may be at least 0.01 inch.

In various examples, the firearm further comprises a barrel nut configured to couple the barrel to the upper receiver. A second gap may be defined between portions of the firearm handguard that circumferentially surround the barrel nut. The second gap may be at least 0.01 inch.

In various examples, the firearm handguard is coupled to the extension mount of the assembly.

In various aspects, a firearm comprises an upper receiver, a barrel coupled to the upper receiver, and a lower receiver coupled to the upper receiver. The lower receiver may comprise a portion that defines a magazine well. The firearm may comprise an extension mount positioned forward of and removably coupled to the portion of the lower receiver that defines the magazine well. The extension mount may be coupled to or monolithic with a handguard of the firearm. The firearm may include a means for coupling the extension mount to the lower receiver.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject matter will become apparent from the description, the drawings, and the claims.

BRIEF DESCRIPTION OF THE DRAWINGS

Figure 1:
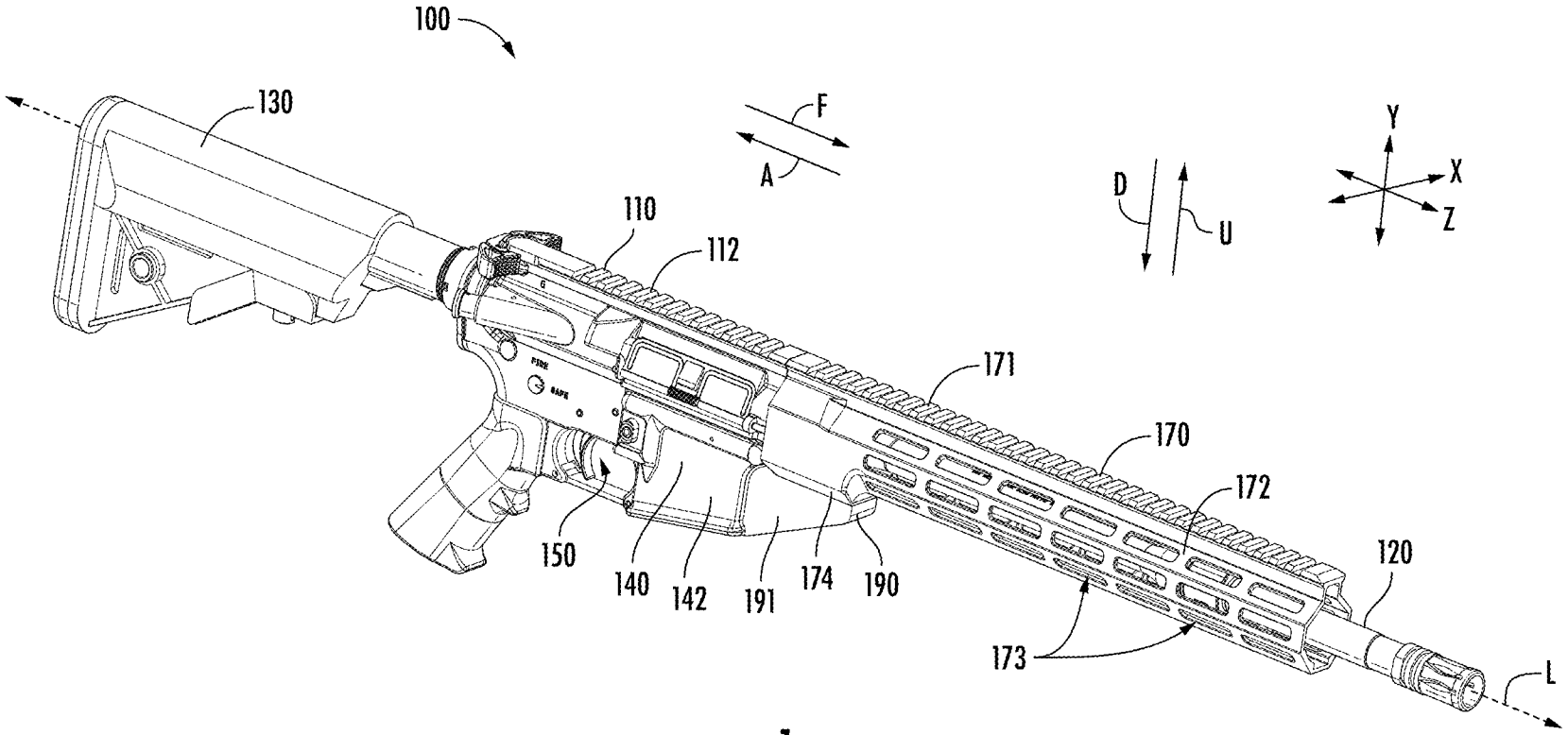

Having thus described certain example embodiments of the present disclosure in general terms above, non-limiting and non-exhaustive embodiments of the subject disclosure are described with reference to the following figures, which are not necessarily drawn to scale and wherein like reference numerals refer to like parts throughout the various views unless otherwise specified. The components illustrated in the figures may or may not be present in certain embodiments described herein. Some embodiments may include fewer (or more) components than those shown in the figures.

FIG. 1 provides a perspective view of a firearm, in accordance with an example embodiment.

Figure 2:
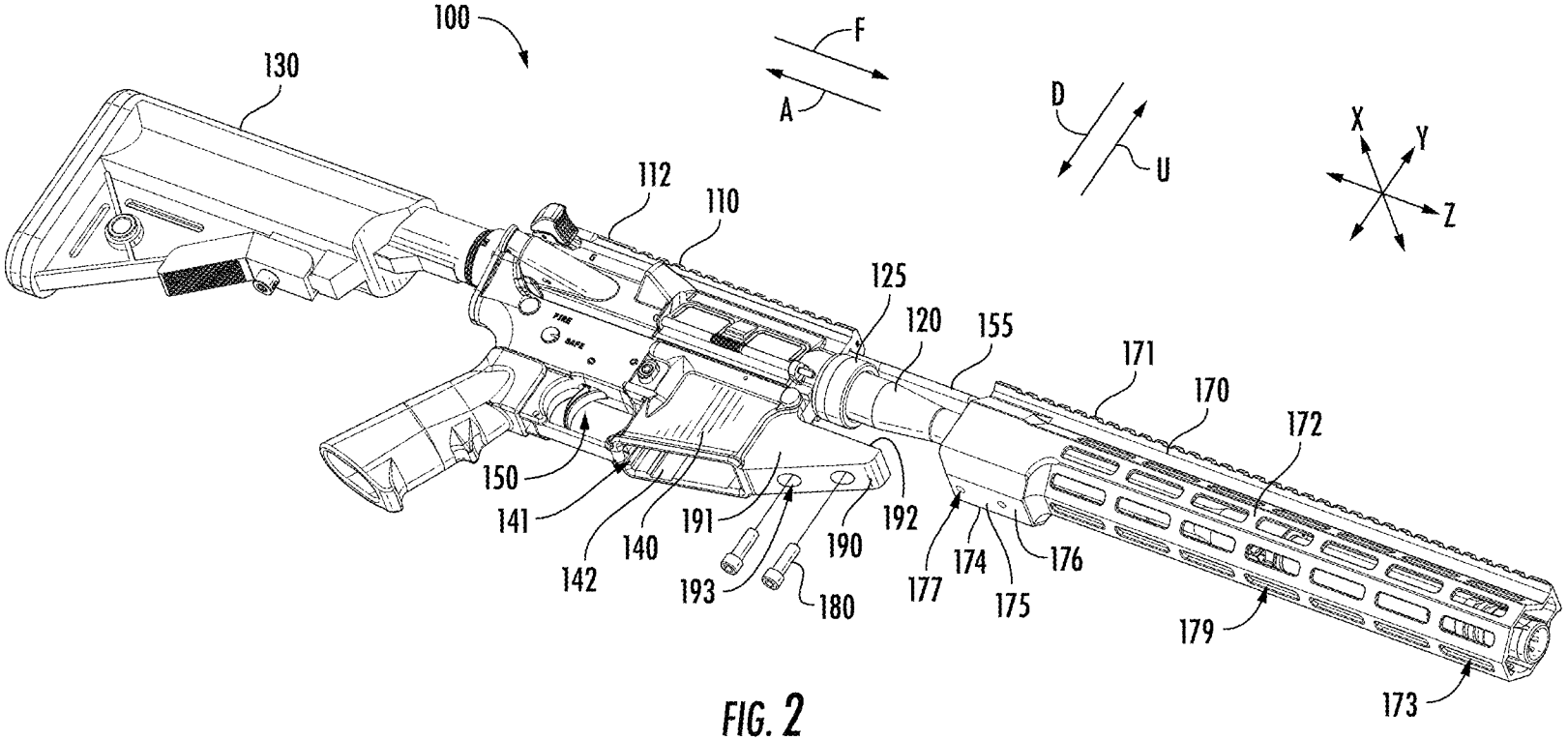

FIG. 2 provides a partially exploded view of the firearm of FIG. 1, in accordance with an example embodiment.

Figure 3A:
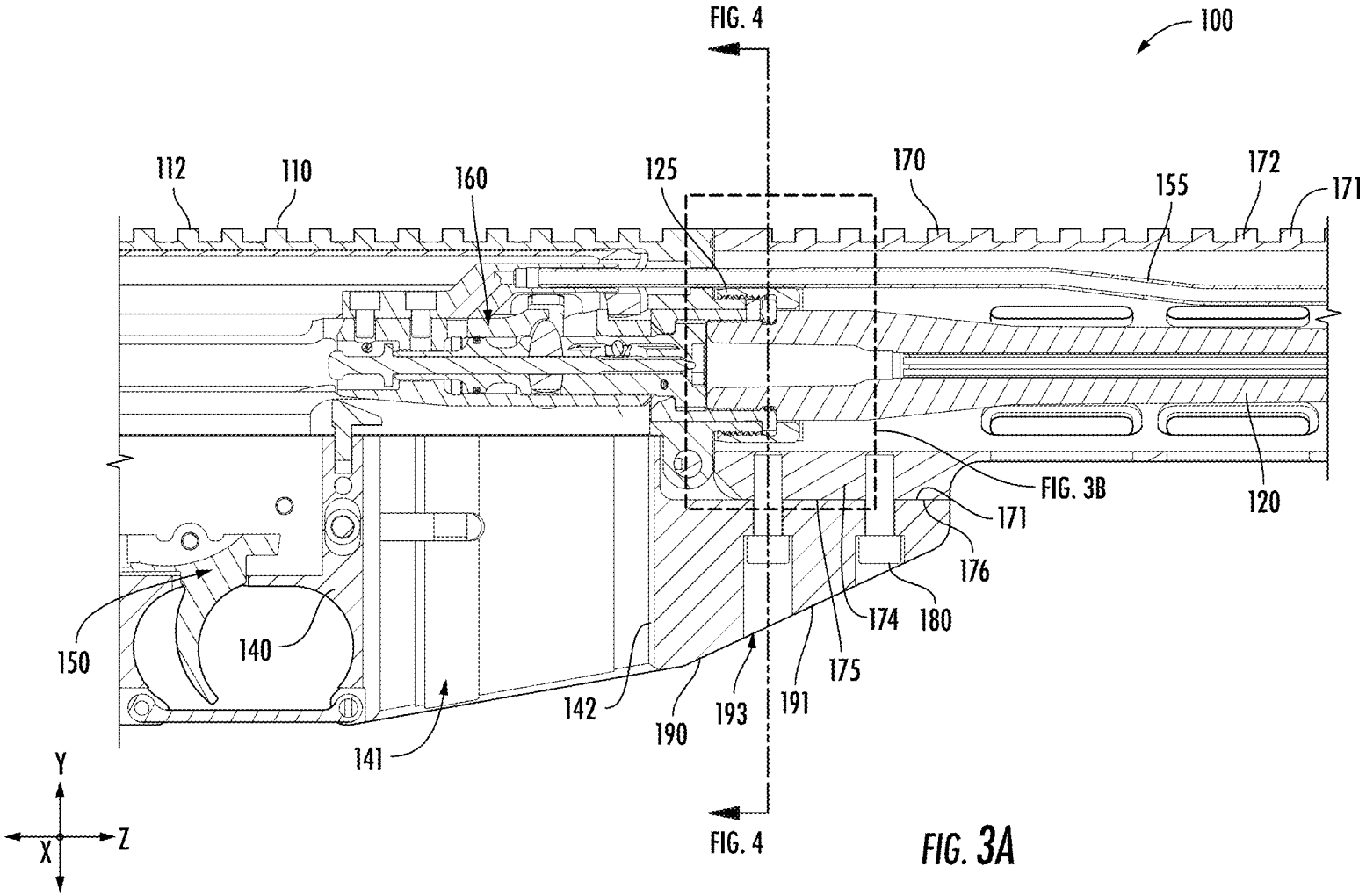

FIG. 3A provides a cross-sectional view of a portion of the firearm of FIG. 1, in accordance with an example embodiment.

Figure 3B:
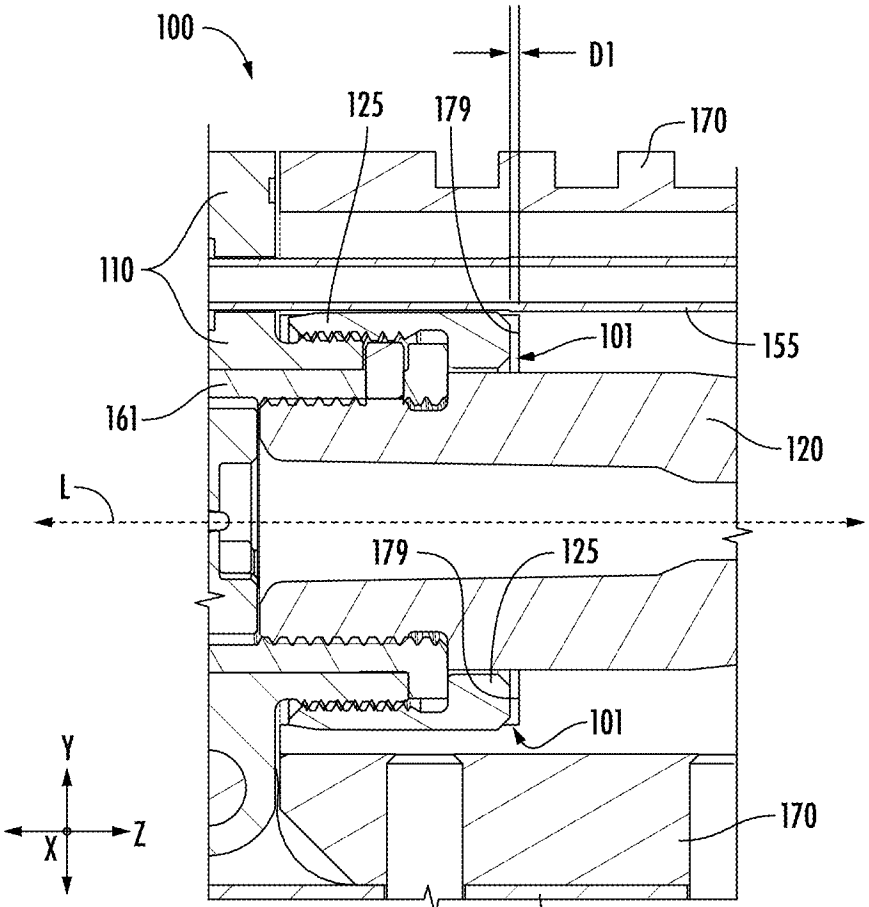

FIG. 3B provides a cross-sectional view of a portion of the firearm of FIG. 1, in accordance with an example embodiment.

Figure 4:
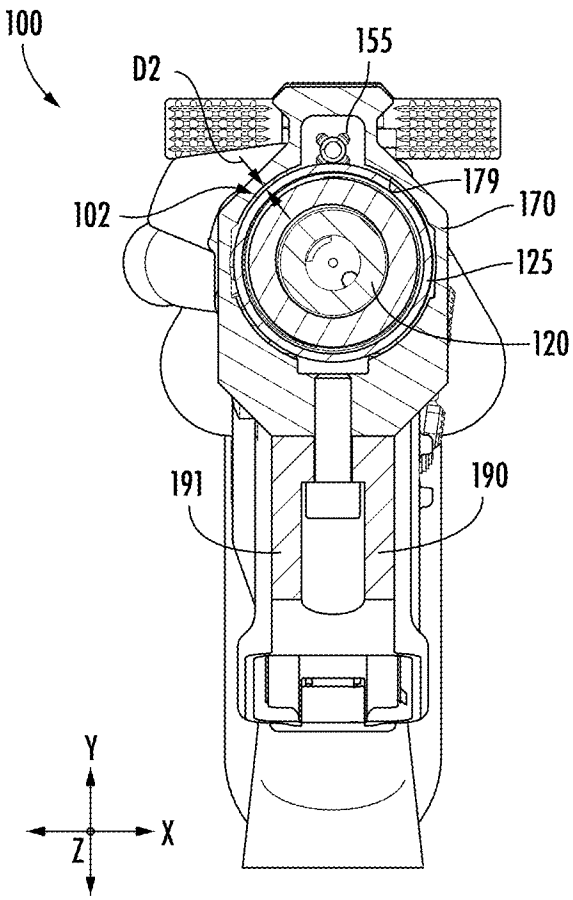

FIG. 4 provides a cross-sectional view of a portion of the firearm of FIG. 1, in accordance with an example embodiment.

Figure 5:
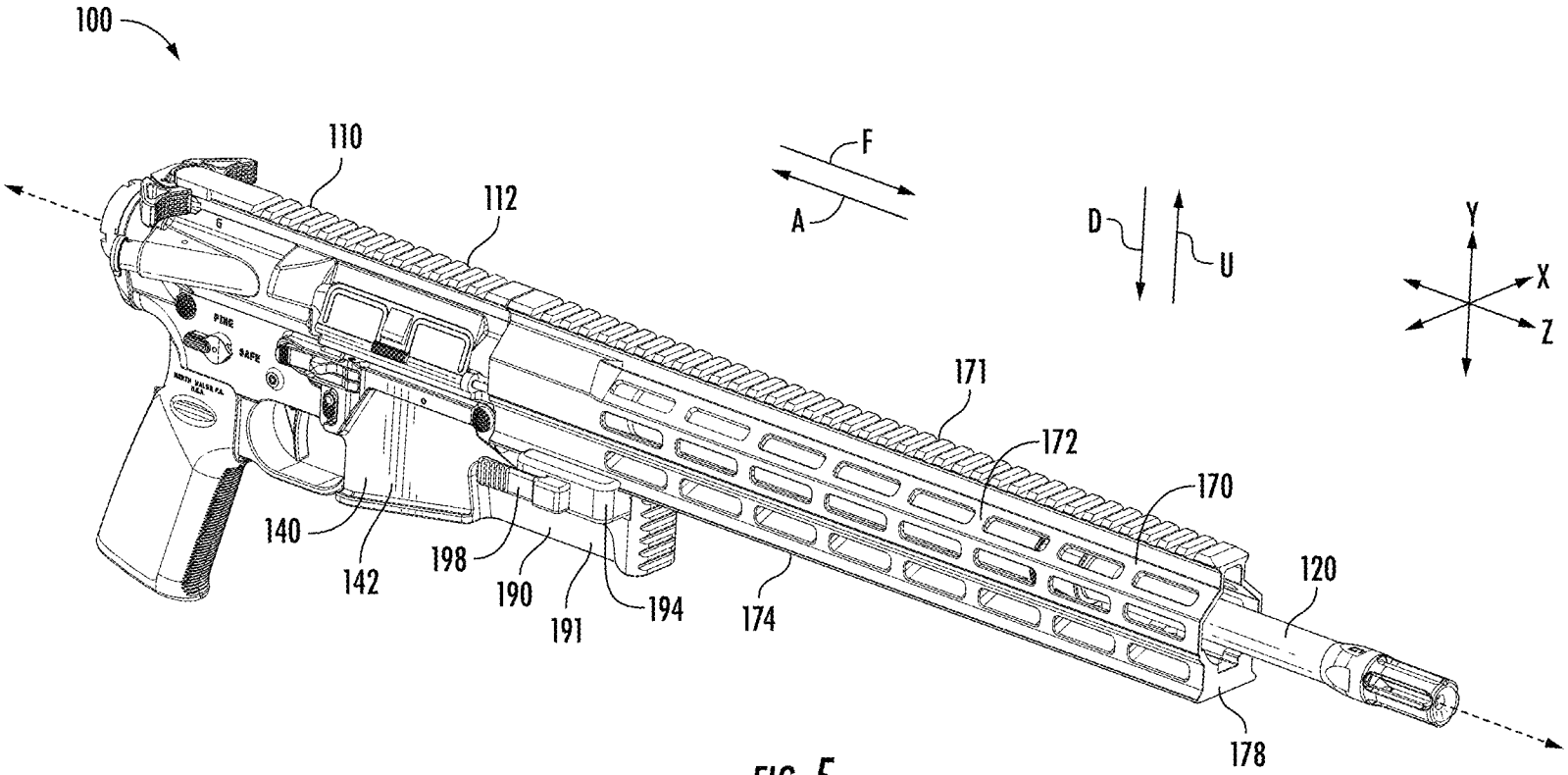

FIG. 5 provides a perspective view of a firearm, in accordance with an example embodiment.

Figure 6:
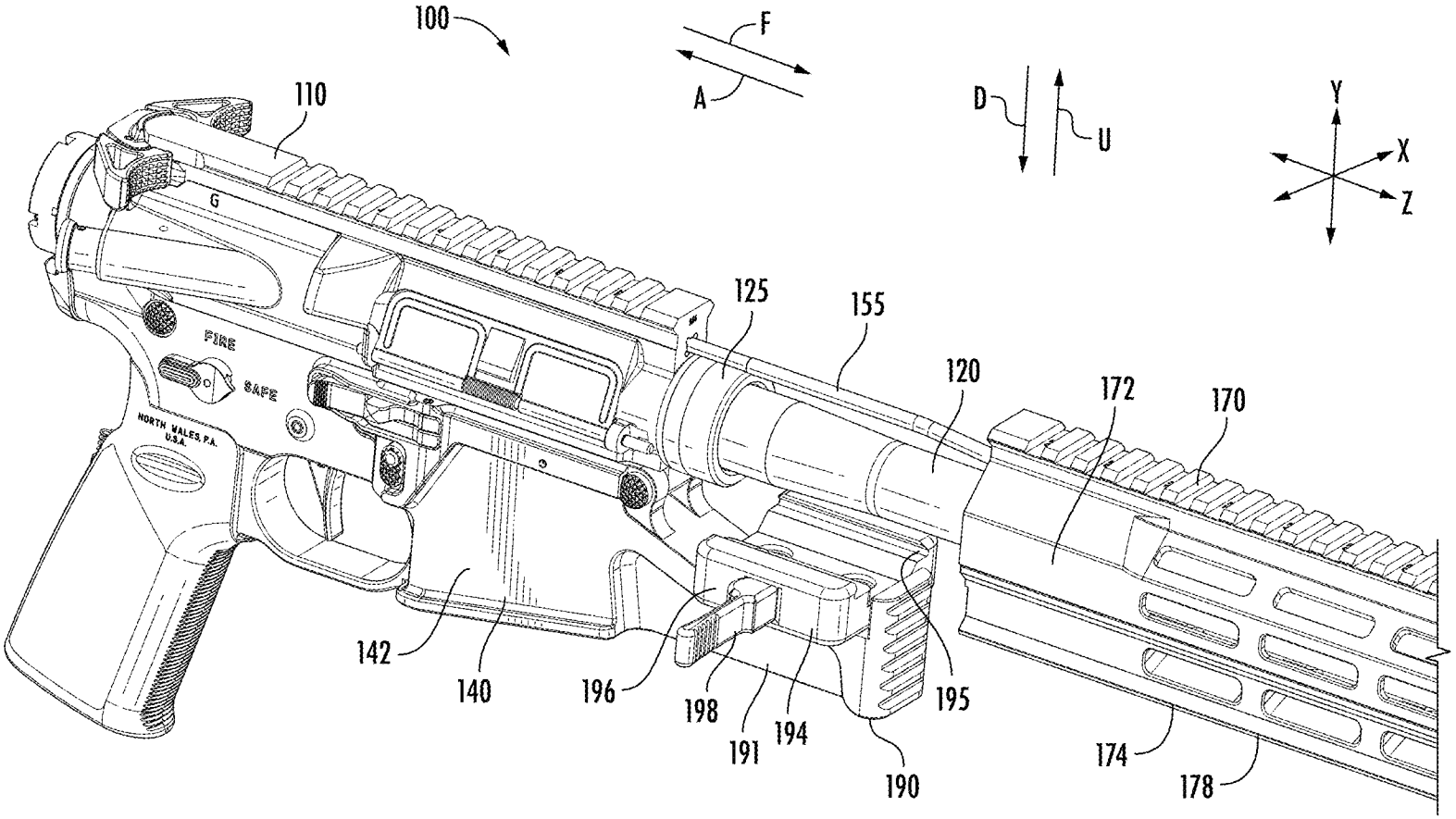

FIG. 6 provides a partially exploded view of a portion of the firearm of FIG. 5, in accordance with an example embodiment.

Figure 7:
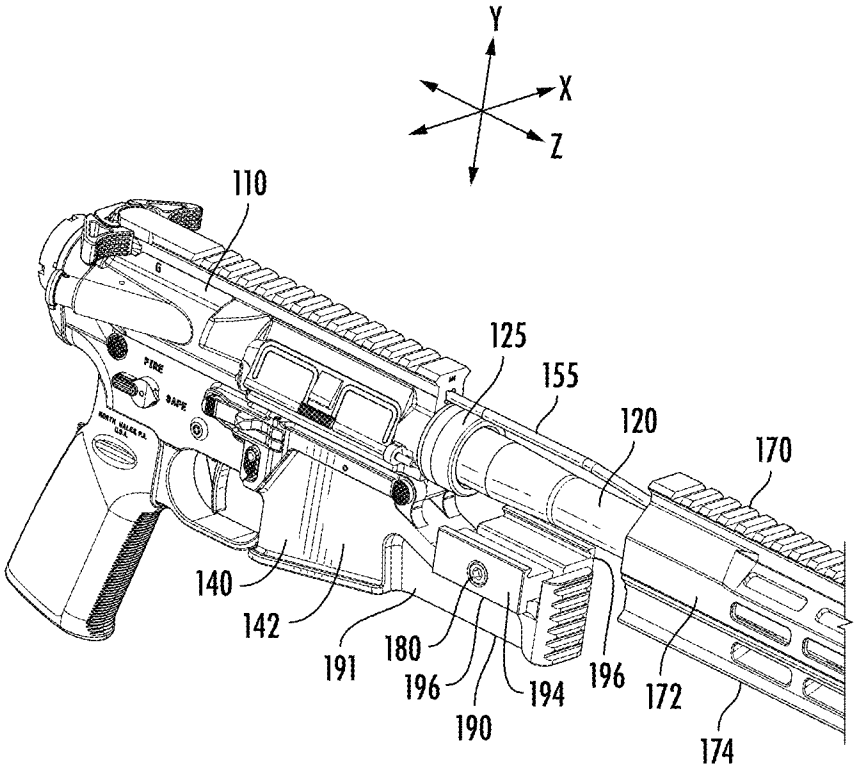

FIG. 7 provides a perspective view of a portion of a firearm, in accordance with an example embodiment.

Figure 8:
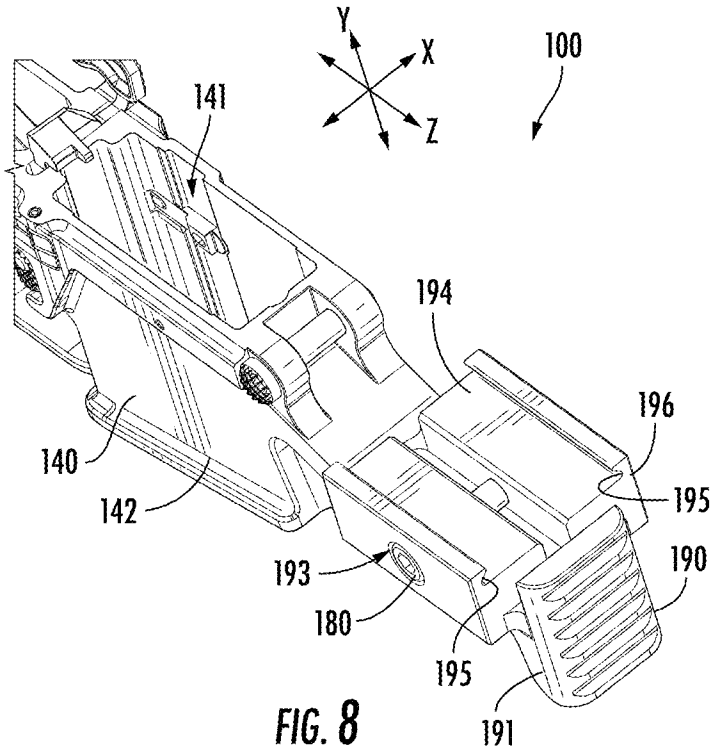

FIG. 8 provides a perspective view of a portion of the firearm of FIG. 7, in accordance with an example embodiment.

Figure 9:
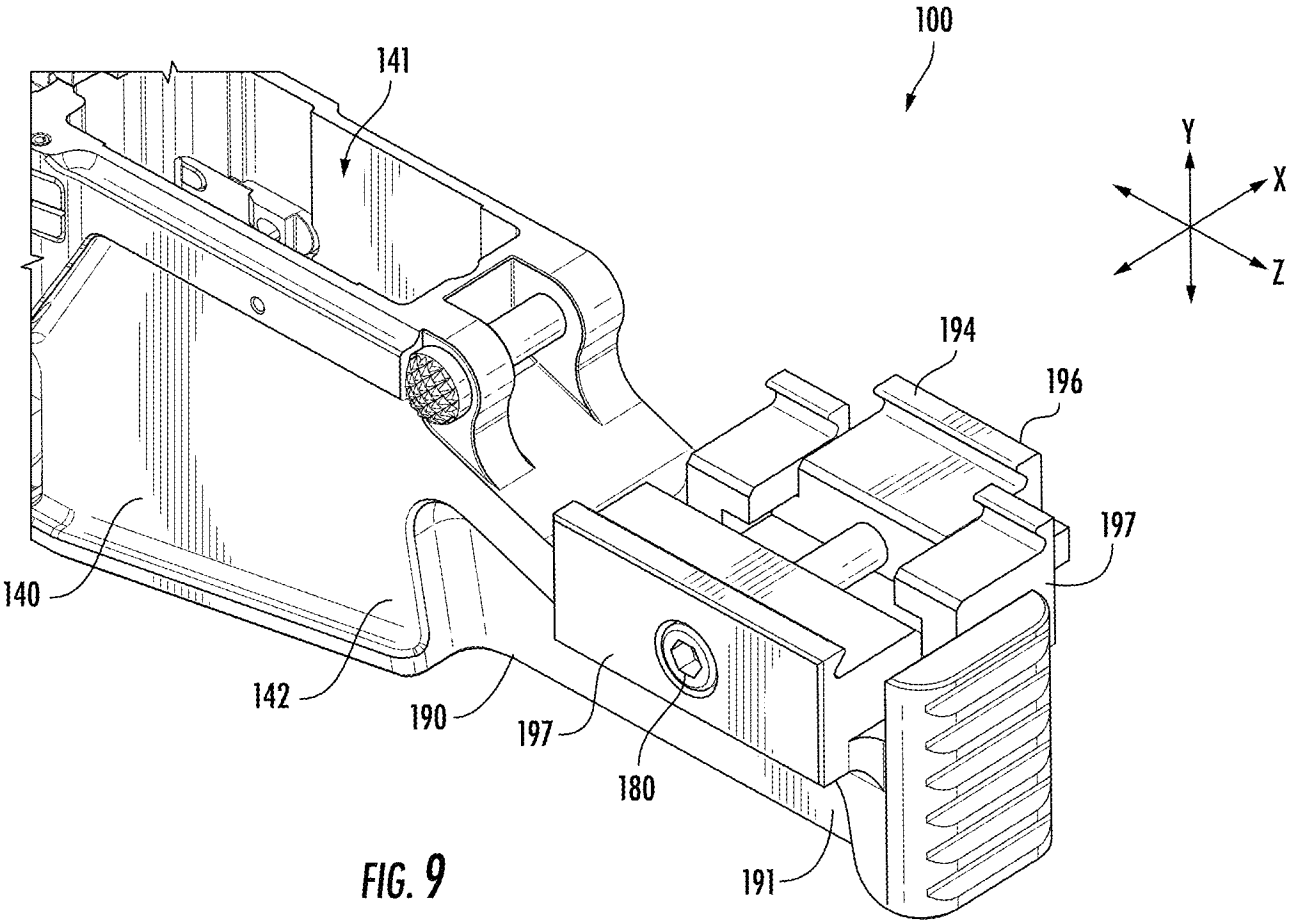

FIG. 9 provides a perspective view of a portion of a firearm, in accordance with an example embodiment.

Figure 10:
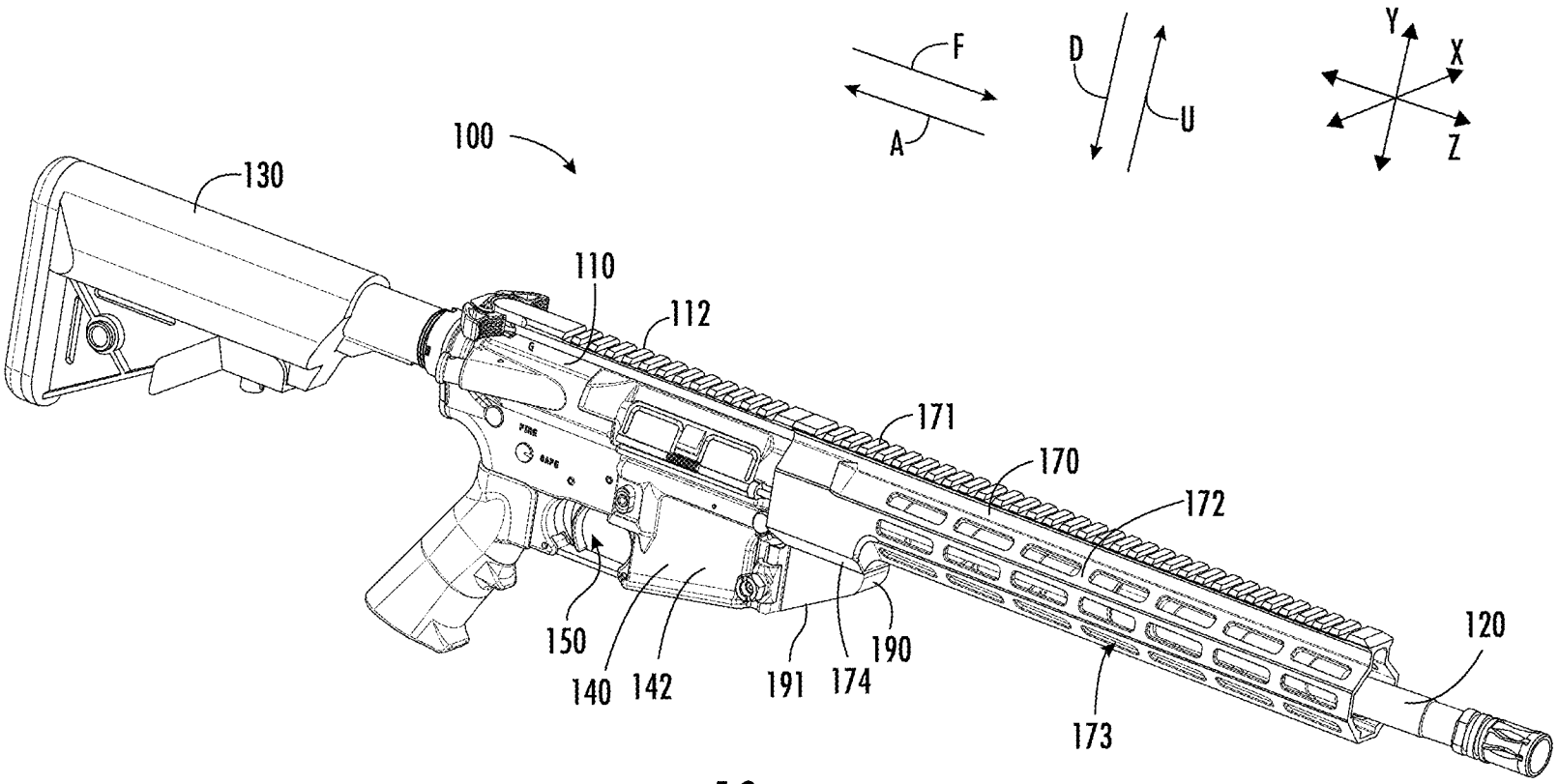

FIG. 10 provides a perspective view of a firearm, in accordance with an example embodiment.

Figure 11:
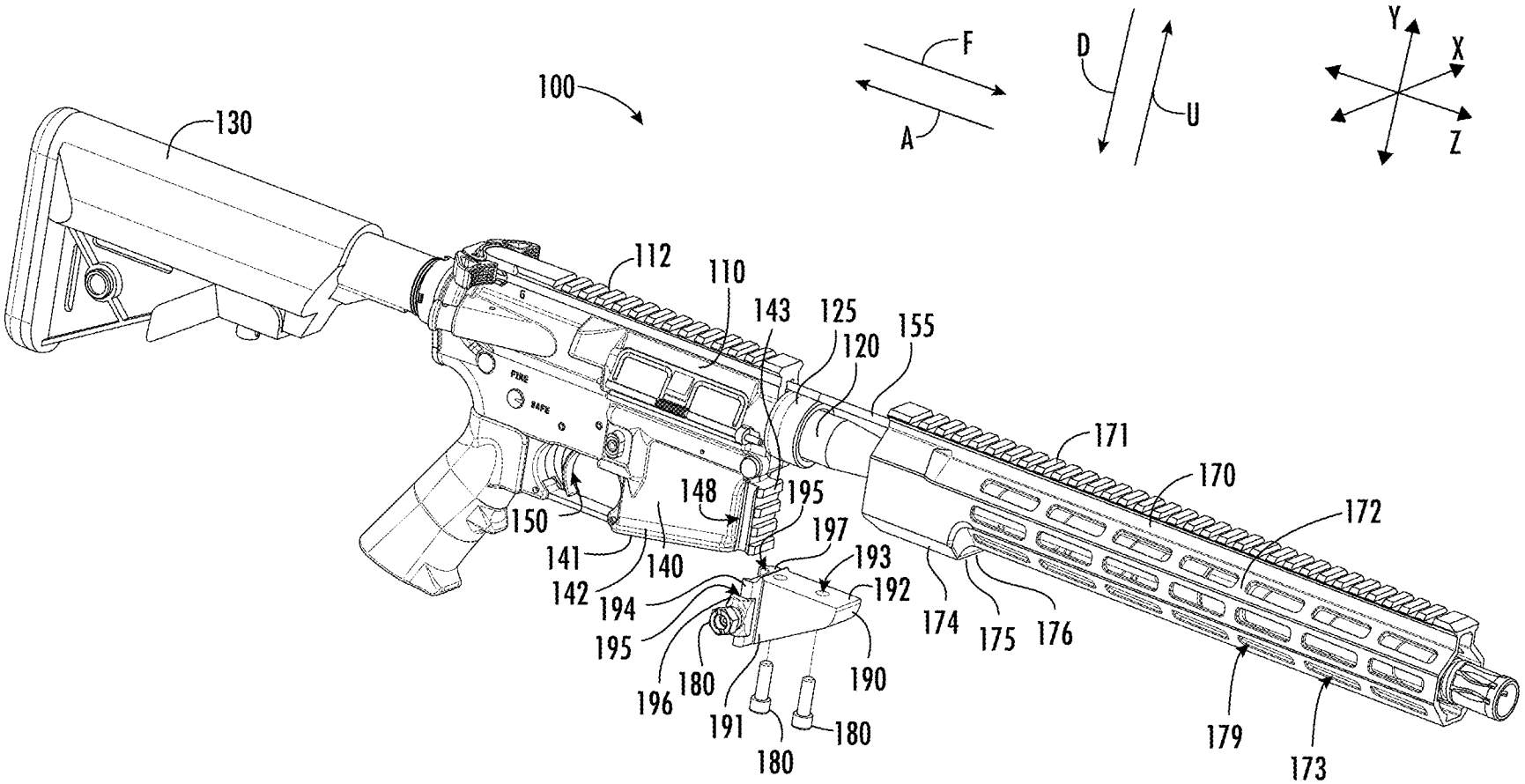

FIG. 11 provides a partially exploded view of the firearm of FIG. 10, in accordance with an example embodiment.

Figure 12:
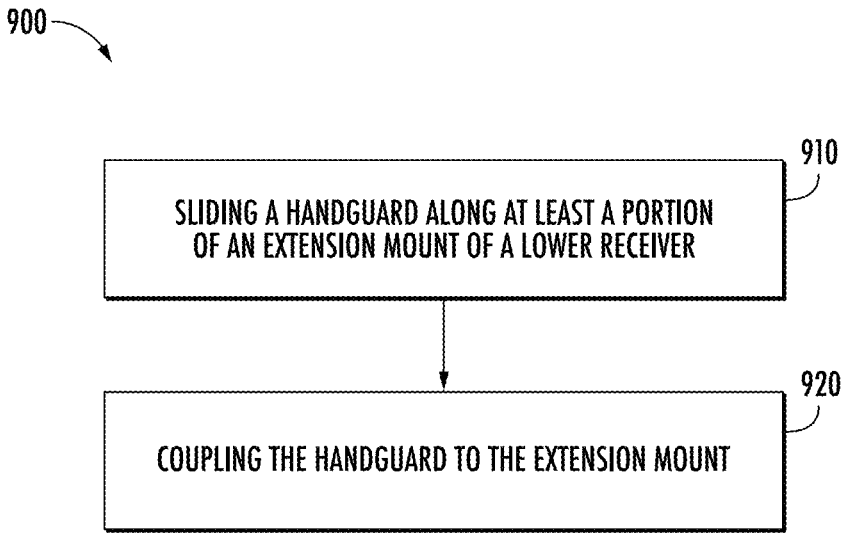

FIG. 12 provides a flowchart of a method of assembling a handguard and lower receiver assembly, in accordance with an example embodiment.

Figure 13:
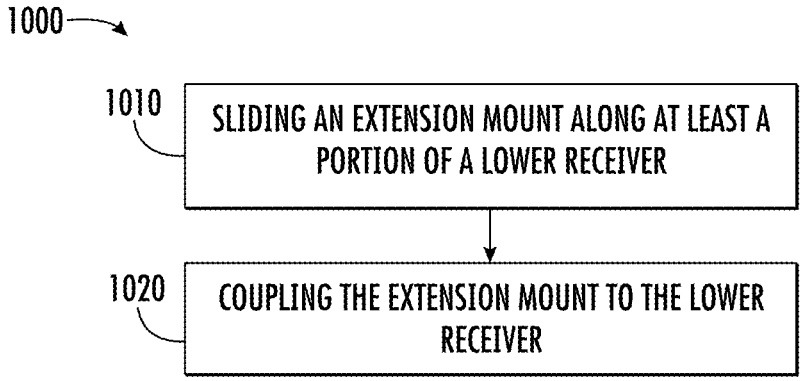

FIG. 13 provides a flowchart of a method of assembling an extension mount and lower receiver assembly, in accordance with an example embodiment.

DETAILED DESCRIPTION

One or more embodiments are now more fully described with reference to the accompanying drawings, wherein like reference numerals are used to refer to like elements throughout and in which some, but not all embodiments of the inventions are shown. In the following description, for purposes of explanation, numerous specific details are set forth in order to provide a thorough understanding of the various embodiments. It is evident, however, that the various embodiments can be practiced without these specific details. It should be understood that some, but not all embodiments are shown and described herein. Indeed, the embodiments may be embodied in many different forms, and accordingly this disclosure should not be construed as limited to the embodiments set forth herein. Rather, these embodiments are provided so that this disclosure will satisfy applicable legal requirements.

As used herein, the term "exemplary" means serving as an example, instance, or illustration. Any aspect or design described herein as "exemplary" is not necessarily to be construed as preferred or advantageous over other aspects or designs. Rather, use of the word exemplary is intended to present concepts in a concrete fashion. In addition, while a particular feature may be disclosed with respect to only one of several implementations, such feature may be combined with one or more other features of the other implementations as may be desired and advantageous for any given or particular application. Furthermore, to the extent that the terms "includes" and "including" and variants thereof are used in either the detailed description or the claims, these terms are intended to be inclusive in a manner similar to the term "comprising."

As used herein, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As used herein, the terms "coupled," "fixed," "attached to," and the like refer to both direct coupling, fixing, or attaching, as well as indirect coupling, fixing, or attaching through one or more intermediate components or features, unless otherwise specified herein.

As used herein, the term "positioned directly on" refers to a first component being positioned on a second component such that they make contact. Similarly, as used herein, the term "positioned directly between" refers to a first component being positioned between a second component and a third component such that the first component makes contact with both the second component and the third component. In contrast, a first component that is "positioned between" a second component and a third component may or may not have contact with the second component and the third component. Additionally, a first component that is "positioned between" a second component and a third component is positioned such that there may be other intervening components between the second component and the third component other than the first component.

As used herein, terms of approximation, such as "approximately," "substantially," or "about," refer to being within manufacturing or engineering tolerances. For example, terms of approximation may refer to being withing a five percent margin of error.

Referring now to FIGS. 1 and 2, a perspective view (FIG. 1) and a partially-exploded view (FIG. 2) of a firearm 100 are provided, in accordance with an example embodiment. The firearm 100 may be configured as a rifle. For example, various embodiments of the firearm 100 discussed herein may include any firearm 100 capable of utilizing a handguard 170, including but not limited to semi-automatic rifles, bolt-action rifles, automatic rifles, and/or shotguns. For example, some embodiments of the firearm 100 may be an M4 platform rifle, AR-15 platform rifle, AR-10 platform rifle, or other similar rifle. In some embodiments, the firearm 100 may be any firearm 100 having a handguard 170.

The firearm 100 may define a longitudinal direction Z, a vertical direction Y that is orthogonal to the longitudinal direction Z, and a lateral direction X that is orthogonal to the longitudinal direction Z and the vertical direction Y. The firearm 100 may define a longitudinal axis L that extends along the longitudinal direction Z and through the barrel 120. The firearm 100 may define a forward direction F and an aft direction A that extend in the longitudinal direction Z and are relative to a shooting orientation of the firearm 100. The firearm 100 may define an upward direction U and a downward direction D that extend in the vertical direction Y and are relative to a shooting orientation of the firearm 100.

The firearm 100 may include an upper receiver 110. The upper receiver 110 may include a rail 112 that is configured to allow one or more firearm 100 accessories to be coupled to the upper receiver 110. For example, the rail 112 may be configured to allow optics (e.g., magnified optics, red dot sights) to be coupled to the rail 112. A barrel 120 may be coupled to the upper receiver 110. For example, a barrel 120 may be coupled to a forward end of the upper receiver 110 with a barrel nut 125 (FIG. 2). The barrel 120 may be configured to allow a projectile, such as a bullet or a slug, to travel through it when the firearm 100 is fired. A stock 130 may be coupled to an aft end of the upper receiver 110.

The firearm 100 may include a lower receiver 140 that is coupled to the upper receiver 110. For example, the lower receiver 140 may be coupled to the upper receiver 110 and positioned downward from the upper receiver 110. The lower receiver 140 may include a magazine well 141. The magazine well 141 may be configured to receive a magazine (not depicted) configured to hold one or more cartridge. Each cartridge may include a projectile, a propellant (e.g., gunpowder or cordite), and primer to ignite the propellant.

The firearm 100 may include a trigger group 150 that is housed, at least partially, within the lower receiver 140. The trigger group 150 may be configured to initiate the firing of the firearm 100, which may cause the projectile to travel through the barrel 120 that is coupled to the upper receiver 110. In various examples, the firearm 100 includes a gas tube 155 (FIG. 2) that may return a portion of high-pressure gas from the barrel 120 via a gas block to a bolt carrier group 160 (FIG. 3) that is coupled to the upper receiver 110.

The firearm 100 may include a handguard 170 that at least partially surrounds the barrel 120 in a circumferential direction around the longitudinal axis L or is otherwise disposed along at least a portion of the barrel 120. The handguard 170 may have an elongated body 172. The elongated body 172 may have a generally cylindrical shape or at least partially polygonal prism shape that extends in the longitudinal direction Z. The handguard 170 may include a plurality of accessory attachment areas and/or features to attach accessories of the handguard 170. For example, the handguard 170 may comprise a rail 171 that is configured to allow one or more firearm 100 accessories to be coupled to the handguard 170. In various examples, the rail 171 is configured as a picatinny type rail. In the depicted embodiments, the rail 171 of the handguard 170 and the rail 112 of the upper receiver 110 are linearly aligned. In various examples, the elongated body 172 of the handguard 170 may include at least one attachment feature 173 (e.g., an opening, a rail, or any other attachment point) that is configured to allow accessories, such as a bipod, to attach thereto. In various examples, the at least one attachment feature 173 is configured as an M-LOK mounting point.

In various examples, the lower receiver 140 includes an extension mount 190 that is positioned at least partially forward of the magazine well 141. For example, the extension mount 190 may be monolithic with a portion of the lower receiver 140 that defines the magazine well 141 and may extend from the portion 142 of the lower receiver 140 that defines the magazine well 141 in the forward direction. As used herein, the term "monolithic" refers to a first component being formed as a single piece with a second component. For example, a first component that is monolithic with a second component can be formed as a single piece with an additive manufacturing process (e.g., 3D printing) or a subtractive manufacturing process (e.g., machining from a solid piece of material). The additive manufacturing process may be a direct energy deposition process (e.g., powder direct energy deposition or wire direct energy deposition), a powder bed fusion process (e.g., selective laser melting or electron beam melting), a binder jetting process, or a bound powder extrusion process. In various examples, the extension mount 190 is not monolithic with the rest of lower receiver 140 and instead is a separate component that is fastened to the portion 142 of the lower receiver 140 that defines the magazine well 141 as part of a multi-part lower receiver. The extension mount 190 may be configured to be coupled to the handguard 170 to form a rigid connection between the lower receiver 140 and the handguard 170. As will be discussed further, in various examples, the handguard 170 is only coupled to the barrel nut 125 through the lower receiver 140 (e.g., in some embodiments, the handguard 170 does not directly apply force to the barrel 120 or barrel nut 125). For example, in various examples, the handguard 170 is only coupled to the barrel nut 125 through the extension mount 190 and the lower receiver 140.

In various examples, the extension mount 190 defines at least one surface 192, such as a top surface that is disposed on an upward side of the extension mount 190. The at least one surface 192 may include at least one hole 193, such as one, two, or three or more holes 193, each for extending a fastener 180 within to rigidly attach the extension mount 190 to the handguard 170. For example, the at least one hole 193 may extend at least partially or completely through a body 191 of the extension mount 190 and through the surface 192. In various examples, the at least one surface 192 of the extension mount 190 is a flat planar surface. In various examples, the at least one surface 192 of the extension mount 190 is non-planar, such as a curved surface.

In various examples, the handguard 170 includes an attachment mount 174 that is positioned at least partially near an aft end of the handguard 170. The attachment mount 174 may be configured to be coupled to the extension mount 190 to form a rigid connection between the handguard 170 and the extension mount 190. The attachment mount 174 may include a pad 175 that extends downward from the elongated body 172 of the handguard 170. The pad 175 may define at least one surface 176 that includes at least one hole 177, such as one, two, or three or more holes 177, to receive a fastener 180. In various examples, and as depicted in FIG. 2, the at least one surface 176 is a flat planar surface. In various examples, the at least one surface 176 of the handguard 170 is non-planer, such as a curved surface.

The at least one surface 176 of the handguard 170 may have a shape that corresponds to a shape of the at least one surface 192 of the extension mount 190. For example, the surface 176 of the handguard 170 may be configured to slide along the surface 192 of the extension mount 190 when the handguard 170 is being installed onto the extension mount 190. In various examples, both the surface 192 of the extension mount 190 and the surface 176 of the handguard 170 are planar surfaces. In various examples, both the surface 192 of the extension mount 190 and the surface 176 of the handguard 170 are curved surfaces such that either the surface 192 of the extension mount 190 or the surface 176 of the handguard 170 is a convex surface and the other is a concave surface.

The at least one hole 193 of the surface 192 of the extension mount 190 may correspond to and align with the at least one hole 177 of the surface 176 of the handguard 170 in an instance in which the handguard 170 is installed on the lower receiver 140. For example, when the handguard 170 is positioned to be coupled to the extension mount 190, the at least one hole 193 of the extension mount 190 may align with the at least one hole 177 of the handguard 170. For example, the at least one hole 193 of the extension mount 190 may align with the at least one hole 177 of the handguard 170 in the vertical direction Y, as depicted in FIG. 2. In various examples, they may align in the lateral direction X, in the longitudinal direction Z, or any other direction.

Referring now to FIGS. 3A, 3B, and 4, cross-sectional views of the firearm 100 of FIG. 1 are provided, in accordance with an example embodiment. The barrel 120 may be coupled to the upper receiver 110 with a barrel nut 125 such that the barrel 120 forms a rigid connection with the upper receiver 110. For example, in some embodiments, the barrel nut 125 may include at least one inner thread that is configured to mate with at least one outer thread on the upper receiver 110. In some embodiments, the barrel 120 may include at least one outer thread that is configured to mate with at least one inner thread of a carrier 161 of the bolt carrier group 160, which may be coupled to the upper receiver 110.

In various examples, and as depicted in some embodiments, the handguard 170 may be positioned such that the handguard 170 abuts and contacts the upper receiver 110 and is not directly coupled to the upper receiver 110. In various examples, the handguard 170 may be positioned such that the handguard 170 abuts and contacts the upper receiver 110 and is directly coupled to the upper receiver 110. In various examples, the handguard 170 may be positioned such that the handguard 170 does not abut or contact the upper receiver 110 and is not directly coupled to the upper receiver 110 (e.g., defining a gap between a distal end of the handguard 170 and a forward-facing surface of the upper receiver 110). In various embodiments, the handguard 170 may not be directly coupled to the upper receiver 110 and may only be coupled to the upper receiver 110 through the lower receiver 140, whether or not the handguard 170 is contacting the upper receiver 110.

The handguard 170 may be positioned such that the handguard 170 at least partially surrounds the barrel nut 125 in a circumferential direction defined by the longitudinal axis L. For example, the barrel nut 125 may be positioned within a bore 179 of the handguard 170. In various examples, a first gap 101 (FIG. 3B) and/or a second gap 102 (FIG. 4) are defined between the handguard 170 and the barrel nut 125. The first gap 101 and the second gap 102, when both included, may merge such that the handguard 170 does not contact the barrel nut 125. The first gap 101 may extend circumferentially around and radially away from the longitudinal axis L. The first gap 101 may be defined between the portions of the barrel nut 125 that align with the handguard 170 in the longitudinal direction Z. The second gap 102 may extend circumferentially around the longitudinal axis and in the longitudinal direction Z. The second gap 102 may be defined between a portion of the handguard 170 that circumferentially surrounds at least a portion of the barrel nut 125.

In various examples, the first gap 101, the second gap 102, or both define a minimum distance between the barrel nut 125 and the handguard 170 that is at least 0.01 inch. For example, the first gap 101 may define a minimum distance D1 between the barrel nut 125 and the handguard 170 that is at least 0.01 inch, such as at least 0.02 inch, such as at least 0.03 inch, such as at least 0.04 inch. The second gap 102 may define a minimum distance D2 between the barrel nut 125 and the handguard 170 that is at least 0.01 inch, such as at least 0.02 inch, such as at least 0.03 inch, such as at least 0.04 inch. In various examples, the first gap 101, the second gap 102, or both define distances D1, D2, that are at least 0.02 inch and up to 0.10 inch. As will be discussed further, providing the first gap 101 between the barrel nut 125 and the handguard 170 may allow the handguard 170 to move in at least the longitudinal direction Z relative to the barrel nut 125. Providing the second gap 102 may allow the handguard 170 to move in at least the lateral direction X and in the vertical direction Y relative to the barrel nut 125.

In various examples, the first gap 101 may define a minimum distance D1 between the barrel nut 125 and the handguard 170 that is at least 0.10 inch, such as at least 2 inches, such as at least 4 inches, such as at least 8 inches, such as at least 12 inches. For example, the barrel nut 125 may be positioned within the bore 179 of the handguard 170, which can extend along at least a portion of the length of the handguard 170. For example, the bore 179 can extend at least 0.10 inch past the barrel nut 125, such as at least 2 inches, such as at least 4 inches, such as at least 8 inches, such as at least 12 inches past the barrel nut 125. In various examples, the bore 179 extends the complete length of the handguard. When the bore 179 extends the complete length of the handguard 170, no portion of the handguard 170 is aligned with the barrel nut 125 in the longitudinal direction Z.

Referring now to FIGS. 5 and 6, perspective views of portions of a firearm 100 are provided, in accordance with an example embodiment. In the depicted embodiment, the attachment mount 174 of the handguard 170 may include an attachment flange 178 that is defined on a downward side of the handguard 170. The attachment flange 178 may extend from an aft end of the handguard 170 and along at least a portion of a length of the handguard 170. In various examples, and as depicted in FIG. 5, the attachment flange 178 has a cross-sectional dovetail shape, such as an ARCA-SWISS style shape. The attachment flange 178 may have any cross-sectional shape, such as a T-shape. As will be discussed further, the attachment flange 178 may be configured to slide along at least a portion of the extension mount 190 when the handguard 170 is being installed on the extension mount 190.

The extension mount 190 may include at least one clamp 194. For example, the at least one clamp 194 may be coupled to the body 191 of the extension mount 190. At least a portion of the clamp 194 of the extension mount 190 may be a moveable portion 196 that is configured to move inward and outward, such as inward and outward along the lateral direction X, relative to the body 191 of the extension mount 190. In various examples, the clamp 194 may include a means for moving the moveable portion 196 of the clamp 194, such as an arm 198. For example, pivoting the arm 198 in a first direction may move the moveable portion 196 of the clamp 194 inward whereas pivoting the arm 198 in a second direction may move the moveable portion 196 of the clamp 194 outward. In various examples, the clamp 194 includes a pair of moveable portions 196 that are configured to move away and toward each other. In various examples, the clamp 194 includes a moveable portion 196 that is configured to move away and toward a stationary portion 197.

The clamp 194 may define at least one groove 195 (FIG. 6) on an inner surface of the clamp 194. For example, the clamp 194 may define a pair of grooves 195 that are positioned on opposite sides of the clamp 194, each extending in the longitudinal direction Z. In various examples, at least one groove 195 is positioned on a moveable portion 196 and at least one groove 195 is positioned on an opposite stationary portion 197. In various examples, at least one groove 195 is positioned on a moveable portion 196 and at least one groove 195 is positioned on an opposite moveable portion 196. Each groove 195 may have a shape that corresponds to the shape of the attachment flange 178 of the handguard 170. For example, each groove 195 may be configured to allow the attachment flange 178 to be positioned within and slide along the groove 195 when the handguard 170 is being installed onto the extension mount 190. The at least one groove 195 and the attachment flange 178 may be shaped to prevent a movement of the handguard 170 in the vertical direction Y relative to the clamp 194.

As discussed, pivoting the arm 198 of the clamp 194 in a first direction may move a moveable portion 196 of the clamp 194 inward and pivoting the arm 198 in a second direction may move the moveable portion 196 of the clamp 194 outward. When the moveable portion 196 of the clamp 194 is moved inward to a first position, and as depicted in FIG. 5, the clamp 194 may become rigidly coupled to the attachment flange 178 of the handguard 170. When the moveable portion 196 of the clamp 194 is moved outward to a second position, and as depicted in FIG. 6, the clamp 194 is not rigidly coupled to the attachment flange 178 and the handguard 170 may be able to slide along the longitudinal axis L relative to the clamp 194. In various embodiments, position of the clamp 194 and attachment flange 178 may be reversed.

Referring now to FIGS. 7 and 8, perspective views of portions of a firearm 100 are provided, in accordance with an example embodiment. In various examples, the means for moving a moveable portion 196 of the clamp 194 may be at least one fastener 180 (e.g., a threaded bolt or other fastening mechanism) that is positioned within a hole 193 that extends at least partially through the clamp 194. The at least one fastener 180 and each corresponding hole 193 may extend in the lateral direction X. The at least one fastener 180 and each corresponding hole 193 may be configured to move the moveable portion 196 of the clamp 194 inward to a first position when the fastener 180 is rotated clockwise and outward to a second position when the fastener 180 is rotated counterclockwise. For example, each fastener 180 and corresponding hole 193 may include at least one thread for moving the moveable portion 196 when the fastener 180 is rotated.

Referring now to FIG. 9, a perspective view of a portion of a firearm 100 is provided, in accordance with an example embodiment. In various examples, the clamp 194 of the extension mount 190 may include at least one stationary portion 197 that is positioned adjacent to at least one moveable portion 196. For example, a moveable portion 196 may be positioned between and adjacent to two stationary portions 197 along the longitudinal direction Z. Each stationary portion 197 may be provided to guide the attachment flange 178 of the handguard 170 into the grooves 195 of the clamp 194. One or more means for moving the moveable portion 196 of the clamp 194 relative to the at least one stationary portion 197 may be provided, such as an arm 198 or a fastener 180.

Various means for rigidly coupling the handguard 170 to the extension mount 190 are contemplated. For example, any means to couple the handguard 170 to the upper receiver 110 only through the lower receiver 140 is contemplated. For example, the handguard 170 may include a clamp 194 that is configured to clamp onto a portion of the extension mount 190, such as an attachment flange, an attachment mount, or similar structure. In various examples, the handguard 170 includes an extension mount 190 that is positioned downward of the handguard 170 and is coupled to or monolithic with the handguard 170. The extension mount 190 of the handguard 170 may be coupled to the portion 142 of the lower receiver 140 that defines the magazine well 141. In various examples, the portion 142 of the lower receiver 140 that defines the magazine well 141 includes an attachment mount 174 for coupling the extension mount 190 of the handguard 170.

Referring now to FIGS. 10 and 11, a perspective view (FIG. 10) and a partially-exploded view (FIG. 11) of a firearm 100 are provided, in accordance with an example embodiment. In various examples, the extension mount 190 is configured to be removably coupled to the lower receiver 140. The extension mount 190 may be removably coupled to a forward portion of the lower receiver 140. For example, the extension mount 190 may not be monolithic with the lower receiver 140 and instead is a separate component that is coupled to a forward end of the portion 142 of the lower receiver 140 that defines the magazine well 141 as part of a multi-part lower receiver. In any of the various embodiments discussed herein, the extension mount may be modified to be separately attached to and removable from the lower receiver.

In various examples, a forward end of the portion 142 of the lower receiver 140 that defines the magazine well 141 includes an attachment feature, such as an attachment flange 148. The lower receiver 140 may include a rail 143 that includes the attachment flange 148. The rail 143 may be configured as a picatinny type rail. In the depicted embodiment, the attachment flange 148 extends generally in the vertical direction Y. The attachment feature may be monolithic with the main body of the lower receiver 140, including the portion 142 that defines the magazine well 141. The attachment feature, such as the attachment flange 148 may be configured to allow accessories, such as a bipod, a tripod, or other mount, to be coupled to the forward end of the portion 142 of the lower receiver 140 that defines the magazine well 141. Additionally, and as will become apparent in light of the present disclosure, the attachment feature may allow the extension mount 190 to be adaptable to different sizes or types of handguards because the extension mount 190 can be moved prior to being firmly coupled to the lower receiver 140.

In various examples, the extension mount 190 may include at least one corresponding attachment feature, such as at least one clamp 194, which may be configured to engage (e.g., clamp to) the attachment feature of the lower receiver 140, such as the rail 143 of the lower receiver 140. At least a portion of the clamp 194 of the extension mount 190 may be a moveable portion 196 that is configured to move inward and outward, such as inward and outward along the lateral direction X, relative to the rail 143 of the lower receiver 140.

The clamp 194 may define at least one groove 195 on an inner surface of the clamp 194. For example, the clamp 194 may define a pair of grooves 195 that are positioned on opposite sides of the clamp 194 with a cavity therebetween for receiving the corresponding attachment feature (e.g., rail 143) of the lower receiver, with each groove 195 extending in the vertical direction Y. Orienting the grooves 195 in the vertical direction may provide additional stability to the handguard. In various examples, at least one groove 195 is positioned on a moveable portion 196 and at least one groove 195 is positioned on an opposite stationary portion 197, as depicted in FIG. 11. In various examples, at least one groove 195 is positioned on a moveable portion 196 and at least one groove 195 is positioned on an opposite moveable portion 196 to adjust the total width of the clamp cavity for securing the extension mount to the lower receiver attachment feature. Each groove 195 may have a shape that corresponds to the shape of the attachment feature, such as the attachment flange 148 of the lower receiver 140. For example, each groove 195 may be configured to allow the attachment flange 148 of the lower receiver 140 to be positioned within and slide within the groove 195 when the extension mount 190 is being installed onto the lower receiver 140. The at least one groove 195 and the attachment feature, such as attachment flange 148, may be shaped to prevent a movement of the extension mount 190 in the longitudinal direction Z relative to the lower receiver 140.

In various examples, the clamp 194 may include a means for moving the moveable portion 196 of the clamp 194. The means for moving the moveable portion 196 of the clamp 194 may be at least one fastener 180 (e.g., a threaded bolt or other fastening mechanism) that is positioned within a hole that extends at least partially through the clamp 194. The at least one fastener 180 and each corresponding hole 193 may extend in the lateral direction X. The at least one fastener 180 and each corresponding hole may be configured to move the moveable portion 196 of the clamp 194 inward to a first position when the fastener 180 is rotated clockwise and outward to a second position when the fastener 180 is rotated counterclockwise. For example, each fastener 180 and corresponding hole 193 may include at least one thread for moving the moveable portion 196 when the fastener 180 is rotated.

Although not depicted in the embodiments of FIGS. 10 and 11, the means for moving the moveable portion 196 of the clamp 194 to couple the extension mount 190 to the lower receiver 140 may be an arm, similar to or the same as arm 198 of FIG. 6. For example, pivoting the arm in a first direction may move the moveable portion 196 of the clamp 194 inward whereas pivoting the arm in a second direction may move the moveable portion 196 of the clamp 194 outward. When the moveable portion 196 of the clamp 194 is moved inward to a first position, the clamp 194 may become rigidly coupled to the attachment flange 148 of the lower receiver 140.

In various examples, the extension mount 190 is configured to be coupled to the handguard 170 to form a rigid connection between the lower receiver 140 and the handguard 170. For example, the extension mount 190 may define at least one surface 192 (also referred to as a "handguard engagement surface"), such as a top surface that is disposed on an upward side of the extension mount 190. The at least one surface 192 may be oriented perpendicular to the at least one clamp 194. The at least one surface 192 may include at least one hole 193, such as one, two, or three or more holes 193, each for extending a fastener 180 within to rigidly attach the extension mount 190 to the handguard 170. For example, the at least one hole 193 may extend at least partially or completely through a body 191 of the extension mount 190 and through the surface 192. In various examples, the at least one surface 192 of the extension mount 190 is a flat planar surface. In various examples, the at least one surface 192 of the extension mount 190 is non-planar, such as a curved surface. In various embodiments, any other attachment mechanism (e.g., fasteners, clamps, etc.) may be used to secure the extension mount 190 to the handguard 170. For example, the attachment mechanisms depicted in FIGS. 1-9, such as the arm 198 and clamp 194 of FIG. 6, the moveable portions 196 and the clamp 194 of FIGS. 7 and 8, and/or the moveable portion 196 and stationary portion 197 of FIG. 9 may be used to secure the extension mount 190 to the handguard 170. In some embodiments, the extension mount 190 and handguard 170 may be monolithic.

In various examples, the handguard 170 includes an attachment mount 174 that is positioned at least partially near an aft end of the handguard 170. The attachment mount 174 may be configured to be coupled to the extension mount 190 to form a rigid connection between the handguard 170 and the extension mount 190. The attachment mount 174 may include a pad 175 that extends downward from the elongated body 172 of the handguard 170. The pad 175 may define at least one surface 176 that includes at least one hole 177, such as one, two, or three or more holes 177, to receive a fastener 180, which may similarly be configured to engage any other attachment mechanism of the extension mount. In various examples the at least one surface 176 is a flat planar surface. In various examples, the at least one surface 176 of the handguard 170 is non-planar, such as a curved surface.

The at least one surface 176 of the handguard 170 may have a shape that corresponds to a shape of the at least one surface 192 of the extension mount 190. For example, the surface 176 of the handguard 170 may be configured to be positioned flush with the surface 192 of the extension mount 190 when the handguard 170 is installed onto the extension mount 190. In various examples, both the surface 192 of the extension mount 190 and the surface 176 of the handguard 170 are planar surfaces. In various examples, both the surface 192 of the extension mount 190 and the surface 176 of the handguard 170 are curved surfaces such that either the surface 192 of the extension mount 190 or the surface 176 of the handguard 170 is a convex surface and the other is a concave surface.

The at least one hole 193 of the surface 192 of the extension mount 190 may correspond to and align with the at least one hole 177 of the surface 176 of the handguard 170 in an instance in which the handguard 170 is installed on the lower receiver 140. For example, when the handguard 170 is positioned to be coupled to the extension mount 190, the at least one hole 193 of the extension mount 190 may align with the at least one hole 177 of the handguard 170. For example, the at least one hole 193 of the extension mount 190 may align with the at least one hole 177 of the handguard 170 in the vertical direction Y. In various examples, they may align in the lateral direction X, in the longitudinal direction Z, or any other direction.

In various examples, the extension mount 190 is monolithic with the handguard 170. For example, the extension mount 190 may be an aft portion of the handguard 170 that protrudes downward from the elongated body 172 of the handguard 170 to couple to the lower receiver 140.

Referring now to FIG. 12, a flowchart of a method 900 of assembling a handguard 170 and lower receiver 140 assembly is provided, in accordance with an example embodiment. The method 900 may include a step 910 of sliding a handguard 170 along at least a portion of an extension mount 190 of a lower receiver 140. For example, an attachment mount 174 of the handguard 170 may be slid along a top surface 192 of the extension mount 190. In various examples, an attachment flange 178 of the attachment mount 174 is slid along a surface that defines grooves 195 of the extension mount 190. The extension mount 190 may be coupled to or monolithic with the portion 142 of the lower receiver 140 that defines a magazine well 141 of the lower receiver 140. The method 900 may include a step 920 of coupling the handguard 170 to the extension mount 190. For example, at least one fastener 180 may be used to couple the handguard 170 to the extension mount 190. In various examples, at least one clamp 194 may be used to couple the handguard 170 to the extension mount 190.

Referring now to FIG. 13, a flowchart of a method 1000 of assembling am extension mount 190 and lower receiver 140 assembly is provided, in accordance with an example embodiment. The method 1000 may include a step 1010 of sliding an extension mount 190 along at least a portion of a lower receiver 140. For example, the extension mount 190 may be slid along an attachment feature, such as an attachment flange 148 of the lower receiver 140. In various examples, grooves 195 of the extension mount 190 may be slid along the attachment flange 148 of the lower receiver 140. The extension mount 190 may be coupled to or monolithic with a handguard 170. The method 1000 may include a step 1020 of coupling the extension mount 190 to the lower receiver 140. For example, at least one fastener 180 may be used to couple the extension mount 190 to the lower receiver 140. In various examples, at least one clamp 194 may be used to couple the extension mount 190 to the lower receiver 140.

The firearm 100 of the present disclosure has various benefits. For example, in various examples, the handguard 170 is only coupled to the barrel nut 125 through the lower receiver 140 and may not make contact with the barrel nut 125. In various other examples, the lower receiver 140 may bear some or all of a load applied to the handguard 170 regardless of contact between the handguard 170 and the upper receiver 110 and/or barrel nut 125. As such, any movement of the handguard 170 may not influence and/or move the barrel nut 125, barrel 120, and/or upper receiver 110. For example, influencing and/or moving the barrel nut 125 may move the barrel 120 relative to the upper receiver 110, which may reduce the accuracy of the firearm 100.

In various circumstances, a user of a firearm may desire to attach a bipod to a handguard. When shooting the firearm with the bipod attached, the user may place their cheek on the stock of the firearm to look through optics that may be positioned on a forward end of the rail of the upper receiver or through sights that are positioned on an aft end of the rail of the upper receiver and a forward end of the rail of a handguard. The user may exert a downward force on the stock with his cheek to look through the optics or sights. If the handguard were directly attached to the barrel nut, the barrel nut may act like a pivot point and the downward force exerted on the stock may cause an aft end of the handguard to move downward slightly relative to a forward end of the handguard that remains stationary due to the bipod. If the handguard were directly attached to the barrel nut, the slight pivot of the handguard may also cause a slight pivot of the barrel nut and barrel relative to the upper receiver that has optics attached. Pivoting the barrel relative to the upper receiver may pivot the barrel relative to the optics or sights on the upper receiver, which may reduce an accuracy of existing firearms. For example, when a bipod is attached to a firearm that has a handguard directly attached to the barrel nut, and a downward force is exerted on the stock, the projectile may hit higher than expected.

The firearm 100 of the present disclosure may not experience this same issue. For example, in various examples, the handguard 170 is not directly coupled to the barrel nut 125 and is only coupled to the barrel nut 125 through the upper receiver 110. As such, a downward force exerted on the stock 130 may not cause the barrel nut 125 to act like a pivot point because an aft end of the handguard 170 is allowed to move relative to the barrel nut 125 and the portions of the firearm that directly support the barrel are not greatly influenced by forces on the handguard. Instead, a downward force exerted on the stock 130 may cause little or no movement of the upper receiver 110, the barrel nut 125, and the barrel 120 or may cause the upper receiver 110, the barrel nut 125, and the barrel 120 to move in unison. Even if the upper receiver 110, the barrel nut 125, and the barrel 120 move in unison in response to a downward force exerted on the stock 130, the user of the firearm 100 can adjust the aim of their firearm 100 accordingly, which may result in an increased likelihood that a projectile will hit the desired target. The firearm 100 of the present disclosure may also result in a greater structural rigidity of the firearm because of the attachment means between the handguard and the lower receiver.

The firearm 100 of the present disclosure may also increase the accuracy of the firearm 100 when a bipod is not used with the firearm 100. For example, a user may grab the handguard 170 while aiming the firearm 100, which may cause the handguard 170 to move relative to the upper receiver 110 and optics coupled to the upper receiver 110. However, because the handguard 170 of the present disclosure is not directly coupled to the barrel nut 125 and is only coupled to the barrel nut 125 through the lower receiver 140, moving the handguard 170 may not cause the barrel nut 125 or the barrel 120 to move relative to the upper receiver 110 and optics coupled to the upper receiver 110. As such, the firearm 100 of the present disclosure may result in an increased likelihood that a projectile will hit the desired target even when the handguard 170 is moved relative to the upper receiver 110.

CONCLUSION

The above descriptions of various embodiments of the subject disclosure and corresponding figures and what is described in the Abstract, are described herein for illustrative purposes, and are not intended to be exhaustive or to limit the disclosed embodiments to the precise forms disclosed. It is to be understood that one of ordinary skill in the art may recognize that other embodiments having modifications, permutations, combinations, and additions can be implemented for performing the same, similar, alternative, or substitute functions of the disclosed subject matter, and are therefore considered within the scope of this disclosure. Therefore, the disclosed subject matter should not be limited to any single embodiment described herein, but rather should be construed in breadth and scope in accordance with the appended claims below. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A firearm comprising:
- an upper receiver;
- a barrel coupled to the upper receiver;
- an assembly coupled to the upper receiver, the assembly comprising:
  - a firearm lower receiver defining a magazine well and comprising an attachment feature positioned forward of the magazine well; and
  - an extension mount that is engaged with the attachment feature of the firearm lower receiver; and
- a firearm handguard coupled to or monolithic with the extension mount of the assembly,
- wherein the extension mount rigidly connects the firearm handguard and the firearm lower receiver,
- wherein the firearm handguard is configured to abut the upper receiver without being directly coupled thereto.

2. The firearm of claim 1, wherein the firearm further comprises a barrel nut configured to couple the barrel to the upper receiver, wherein a first gap is defined between portions of the barrel nut that longitudinally align with the firearm handguard, wherein the first gap is at least 0.01 inch.

3. The firearm of claim 1, wherein the firearm further comprises a barrel nut configured to couple the barrel to the upper receiver, wherein a second gap is defined between portions of the firearm handguard that circumferentially surround the barrel nut, wherein the second gap is at least 0.01 inch.

4. The firearm of claim 1, wherein the firearm handguard is coupled to the extension mount of the assembly.

5. The firearm of claim 1, wherein the extension mount comprises a clamp and the extension mount is coupled to the firearm lower receiver with the clamp.

6. The firearm of claim 5, wherein the clamp comprises a fastener and a moveable portion, wherein the fastener is configured to move the moveable portion when rotated.

7. The firearm of claim 5, wherein the clamp comprises an arm that is configured to pivot and a moveable portion, wherein the arm is configured to move the moveable portion when pivoted.

8. The firearm of claim 1, further comprising one or more fasteners, wherein the extension mount comprises one or more holes configured to receive each of the one or more fasteners to couple the extension mount to the firearm handguard.

9. The firearm of claim 1, wherein the attachment feature is an attachment flange.

10. The firearm of claim 9, wherein the firearm lower receiver comprises a rail, wherein the rail comprises the attachment flange.

11. The firearm of claim 10, wherein the rail is a picatinny type rail that is monolithic with a portion of the firearm lower receiver that defines the magazine well.

12. The firearm of claim 1, wherein the firearm defines a downward direction relative to a shooting orientation of the firearm, wherein the firearm handguard comprises:

an elongated body; and an attachment mount at or proximate to a downward aft end of the elongated body, the attachment mount comprising a pad that extends downward from the elongated body, the pad configured to couple to the extension mount to form a rigid connection between the firearm lower receiver and the firearm handguard.

13. A firearm defining a vertical direction relative to a shooting orientation of the firearm, the firearm comprising:

an upper receiver;

a barrel coupled to the upper receiver;

an assembly coupled to the upper receiver, the assembly comprising:

a firearm lower receiver defining a magazine well and comprising an attachment feature positioned forward of the magazine well; and an extension mount that is engaged with the attachment feature of the firearm lower receiver; and a firearm handguard coupled to or monolithic with the extension mount of the assembly, wherein the extension mount and the firearm handguard comprise one or more vertical holes configured to receive a fastener to couple the extension mount to the firearm handguard.

14. A firearm comprising:

an upper receiver;

a barrel coupled to the upper receiver;

an assembly coupled to the upper receiver, the assembly comprising:

a firearm lower receiver defining a magazine well and comprising an attachment feature positioned forward of the magazine well; and an extension mount that is engaged with the attachment feature of the firearm lower receiver; and a firearm handguard coupled to or monolithic with the extension mount of the assembly, wherein the extension mount rigidly connects the firearm handguard and the firearm lower receiver, wherein the extension mount comprises:

a handguard engagement surface configured to engage the firearm handguard; and at least one clamp configured to engage the attachment feature of the firearm lower receiver.

15. The firearm of claim 14, wherein the firearm defines an upward direction that is relative to a shooting orientation of the firearm, and wherein the handguard engagement surface comprises at least one upwardly-facing opening configured to receive at least one corresponding fastener therethrough to engage the firearm handguard.

16. The firearm of claim 14, wherein the at least one clamp is oriented perpendicular to the handguard engagement surface.

* * * * *